United States Patent [19]

Clymer, deceased

[11] 3,975,887

[45] Aug. 24, 1976

[54] CONTROL DEVICE FOR CONVEYOR

[75] Inventor: Joseph D. Clymer, deceased, late of Fort Wayne, Ind., by Bonita E. Clymer, special administratrix

[73] Assignee: Lincoln Manufacturing Company, Inc., Fort Wayne, Ind.

[22] Filed: Nov. 13, 1974

[21] Appl. No.: 523,327

[52] U.S. Cl. ..... 53/373; 83/304; 83/528; 83/564

[51] Int. Cl.[2] ..... B65B 7/16; B65B 51/16

[58] Field of Search ..... 53/201, 298, 296, 329, 53/373, 389, 182, 266, 282; 83/304, 528, 564

[56] References Cited

UNITED STATES PATENTS

| | | | |
|---|---|---|---|
| 1,192,350 | 7/1916 | Sather | 83/564 X |
| 2,931,151 | 4/1960 | Simeone et al. | 53/389 X |
| 3,116,580 | 1/1964 | Anderson | 53/329 |
| 3,130,621 | 4/1964 | Else | 83/564 X |
| 3,436,894 | 4/1969 | Sorensen | 53/373 X |
| 3,490,196 | 1/1970 | Sorensen | 53/389 X |
| 3,553,930 | 1/1971 | Anderson et al. | 53/329 X |
| 3,706,175 | 12/1972 | Anderson | 53/329 X |
| 3,738,082 | 6/1973 | Anderson | 53/329 |

*Primary Examiner*—Othell M. Simpson
*Assistant Examiner*—Horace M. Culver
*Attorney, Agent, or Firm*—Albert L. Jeffers; Roger M. Rickert

[57] ABSTRACT

A packaging device for closing packages, especially food packages, and which is adapted for selective adjustment from a first condition for packaging cold food and a second condition for packaging hot food.

11 Claims, 6 Drawing Figures

CONTROL DEVICE FOR CONVEYOR

The present invention relates to a packaging device, and especially a packaging device which is adjustable to provide for two modes of operation, and wherein an element of the machine which is employed in only one mode of operation does not get out of step when the machine is adjusted for the other mode of operation.

The particular class of articles that are especially adapted for being packaged in comformity with the present invention are cold food packages and hot food packages. Such packages of food are widely used to provide lunches in institutions such as schools and the like.

The cold foods can advantageously be placed in a plastic tray and sealingly enclosed by a strip of plastic material or the like which is heat sealed to the top of the plastic tray while the plastic tray is being conveyed. The plastic covering material is cut between successive trays during movement of the trays along the conveyor. In this manner, the packages are handled rapidly and efficiently and sanitary conditions are maintained.

When hot food is to be packaged, however, this food is placed in a foil tray, and it is not possible to close the tray in the same simple manner. Rather, when hot food is being processed, the foil trays in which the hot food is disposed are sealed by foil covers or the like which are placed on the trays manually. One and the same conveying apparatus, however, is suitable for conveying both types of trays during the loading of the trays with food and the closing of the trays and up until the time the trays are delivered to receiving baskets or the like therefor.

The present invention is particularly concerned with the provision of an arrangement associated with a conveyor of the nature referred to which can readily be adjusted into one position for handling cold food trays and into a second position for handling hot food trays.

More specifically, when the device is adjusted for handling cold food trays, a sheet of the material which is used for covering the cold food trays is continuously supplied to the tops of the trays and is heat sealed thereto and is automatically severed between adjacent trays. This device, especially the cutting portion thereof, is retracted when hot food trays are being handled, but the cutting element, which must be precisely timed in respect of the movement of trays along the conveyor, remains in time in each adjusting position so that conversion of the machine from one type of operation to the other and then back again involves no problems whatsoever.

BRIEF SUMMARY OF THE INVENTION

According to the present invention, a conveyor is provided moveable in a generally horizontal direction and comprising upwardly opening compartments in which small food trays can be placed. During movement of the trays along the conveyor, foodstuffs are placed therein, for example, a group of foodstuffs making up a meal such as might be served in an institution of the nature of a school or the like.

On occasion, the foods placed in the trays will be cold, and in this case, the trays are plastic, and during movement thereof on the conveyor pass beneath a sealing station where a film of sealing material is heat sealed to the top of the tray. The trays are moved beneath a heated sealing roller and the sealing film is fed into the region where the trays pass beneath the roller.

The trays with the film sealed thereto then pass beneath a rotary cutting knife which is timed to sever the film between adjacent trays. The trays are then lifted off from the compartments in which they are disposed and discharged from the conveyor into a basket or to a suitable receiver.

When the food to be placed in the trays is hot, trays of the same size are employed and are placed in the same upwardly opening compartments in the conveyor but, in this case, the trays are formed of metal foil. In this case, the heat sealable film is not supplied to the trays, and the rotary severing knife is adjusted to inoperative position and the trays are enclosed and sealed by manually placing a cover thereon.

The cover may be foil or it may be cardboard with the foil of the tray clamped about the edges thereof. In any case, this operation is manual and the rotary severing knife is not, at this time, operative and is, instead moved to inoperative position.

Inasmuch as the food packaging process might alternate between packaging hot foods and packaging cold foods, it is convenient to be able to adjust the machine into its two operative conditions without getting the severing blade out of time.

This is accomplished by mounting the severing blade on a swing frame by means of which the blade can be moved between an operative position for a cold food packaging and an inoperative position for hot food packaging, while a drive train to the severing blade remains in engagement at all times. Thus, there is no change in the timing of the rotary severing blade when it is moved from inoperative position back into operative position.

With the foregoing in mind, an object is the provision of an apparatus of the nature referred to which can be adjusted between two conditions of operation without getting any part of the machine out of time.

A particular object of the present invention is the provision of an arrangement for moving a rotary cutting blade between operative and inoperative positions while keeping the cutting blade in time with the remainder of the machine at all times.

The exact nature of the present invention will become more clearly apparent upon reference to the following detailed specification taken in connection with the accompanying drawings in which.

DETAILED DESCRIPTION OF THE INVENTION

Figure 1:
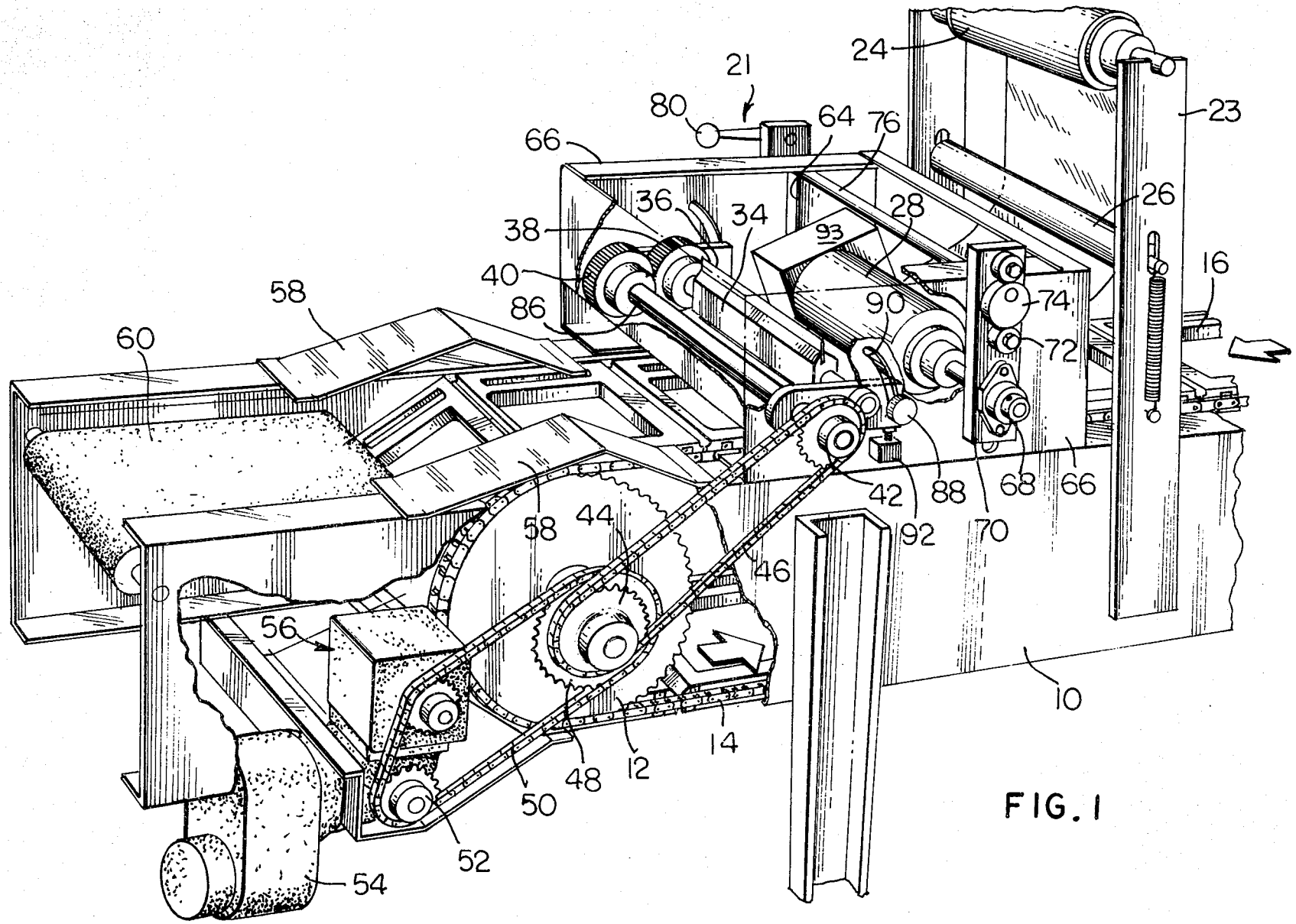
FIG. 1 is a fragmentary perspective view showing the discharge end of a packaging apparatus according to the present invention.
Figure 6:
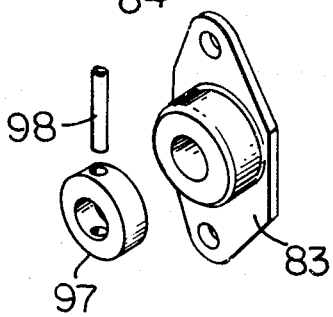
FIG. 6 is a fragmentary view showing a connecting element which connects the conveyor chain with the compartments moved thereby.
Figure 6:
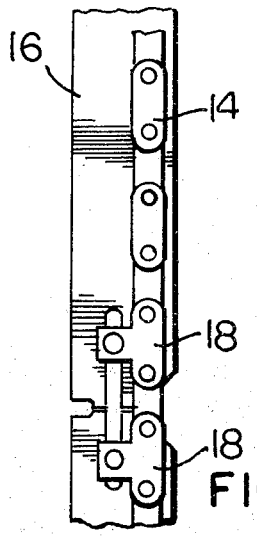

Referring to the drawings somewhat more in detail, the apparatus illustrated in FIG. 1 will be seen to comprise a frame 10. The frame 10 has mounted therein in spaced relation sprockets 12 over which are entrained chains 14. In the drawings, only one sprocket 12 is illustrated and only one of the chains 14 is illustrated, but it will be understood that there are sprockets and chains at both sides of the frame. Each chain 14 is connected to each of a plurality of tray support members 16 as by one or more of the clips 18 as illustrated in FIG. 6.

Figure 3:
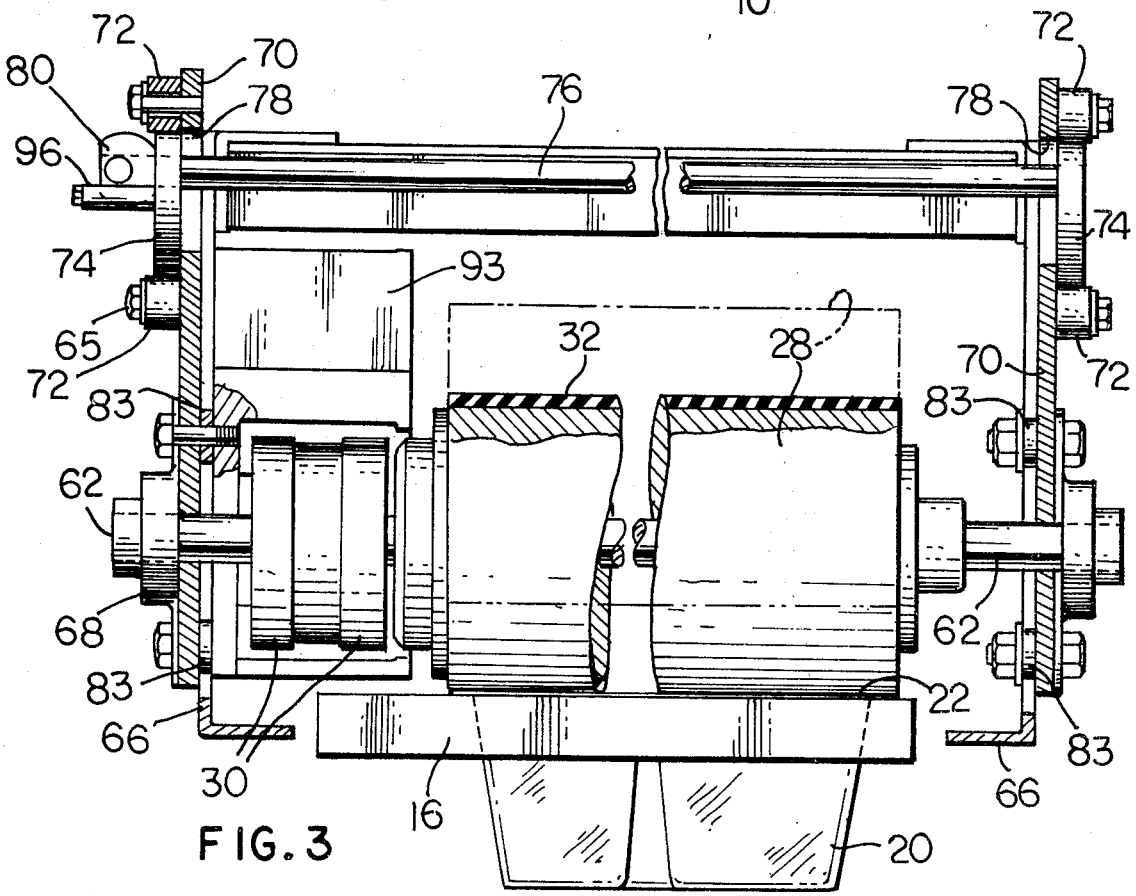
FIG. 3 is a transverse section indicated by line III—III on FIG. 2 showing details of construction of the heat sealing roller.

The members 16 are arranged in substantially end to end relation and support food trays 20 somewhat in the manner illustrated in FIG. 3. Each tray has a flared out rim 22 at the top resting on top of the respective member 16 while an aperture provided in the member permits the tray to extend downwardly therethrough.

In FIG. 1, the conveyor made up of chains 14 and tray supporting members 16 rotates in the direction such that the upper reach of the chain moves toward the left. Toward the right of FIG. 1, in a region not illustrated in the drawings, the trays are provided with the foodstuffs to be carried by the respective trays.

When the machine is adjusted for packaging cold foodstuffs and a film of material is to be sealed to the top of each tray, the mechanism generally indicated at 21 in FIG. 1 is availed of. This mechanism comprises a support arrangement 23 for supporting a reel 24 of the heat sealable material and which material passes downwardly and about a spring loaded idler roller 26 and then angles downwardly and toward the left and passes beneath a heated sealing roller 28 having a terminal box 93 which, as will be seen in FIG. 3, is adapted to roll on the rim 22 of the trays as the trays move therebeneath.

The heat sealing roller 28 is advantageously electrically heated as by a heating element therein connected to slip rings 30 and may be provided with a rubber-like enclosing sleeve 32. The heat sealing roller 28 normally need not be driven because it will be caused to rotate by the movement of the food trays therebeneath and by the film which is being sealed to the tops of the trays.

Immediately leftwardly of heat sealing roller 28 is a rotary cut off or severing blade 34. This blade may have two diametrically opposed sharp cutting elements 36 mounted thereon and is intended to cause the cutting edges to cut off the film which is heat sealed to the tops of the food trays between adjacent trays.

For timing the rotation of cutter 34, the cutter is mounted on a shaft having at one end a gear 38 meshing with another gear 40 which is carried by a shaft having thereon a sprocket 42. A further sprocket 44 on the same shaft as the first mentioned conveyor sprocket 12 is connected to sprocket 42 by chain 46 which is entrained about sprockets 42 and 44.

A still further sprocket 48 is provided on the same said shaft as sprockets 12 and 44 and is connected by chain 50 with a driven sprocket 52 which is driven in rotation by a drive motor 54 via a step down transmission 56.

After the food trays, which are now sealed and cut apart, emerge from beneath the rotary cutter 36, the end edges of the flanges 22 thereof are engaged by the inclined members 58 which lift the trays upwardly away from members 16 and disengage the trays from the members 16. The trays, now disengaged from the conveyor, will slide down the members 58 to an exit conveyor 60 for being conveyed to a suitable receiving station which may consist of a basket or the like in which a plurality of the packages are placed for being transported to a point of use.

The operation described above is carried out when the food trays are formed of plastic material and cold foodstuffs are packaged thereon. When the foodstuff is hot, however, the food trays are made of metal foil and the heat sealing roller 28 is retracted upwardly and the cut off mechanism including cutter 34 is also retracted upwardly and the metal foil trays then pass idly beneath the sealing and cut off station and are subsequently manually closed by a suitable cover member.

The motion taken by the heat sealing roller between lower operative position and upper inoperative position is imparted thereto by rotary cam means manually moveable to move the roller between the two aforementioned positions.

Figure 5:
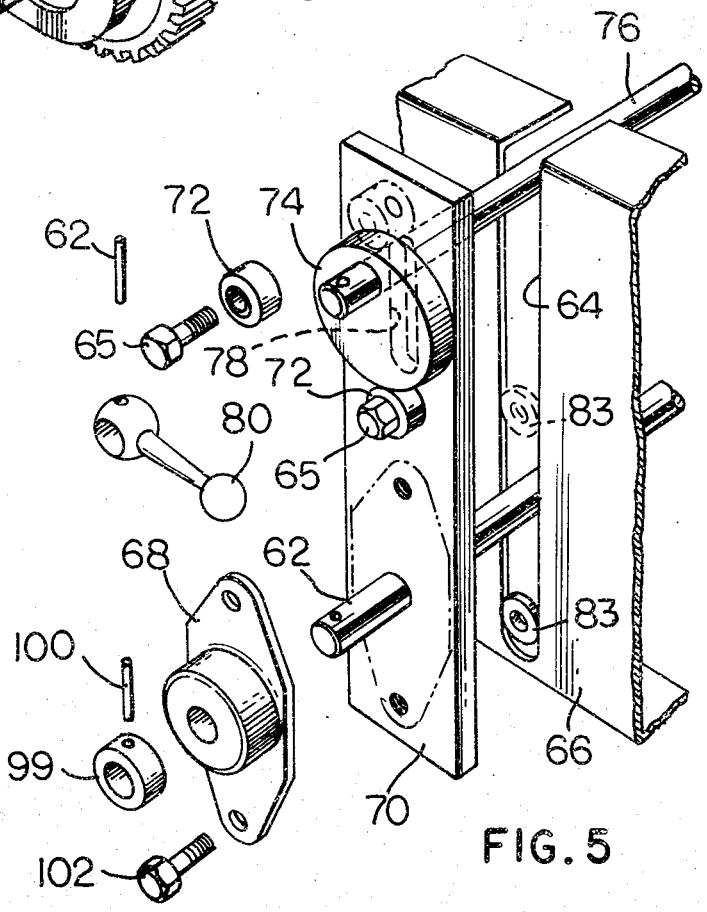
FIG. 5 is a perspective view showing the mechanism by means of which the heat sealing blade is moved between operative and inoperative positions.

This is accomplished by extending the shaft of roller 28, said shaft being indicated at 62, through slots 64 formed in the framework 66 adjacent the ends of the heat sealing roller. The opposite ends of shaft 62 are rotatably supported in bearings 68 fixed to plates 70. The plates 70 each carry a pair of vertically spaced rollers 72 which embrace therebetween a respective circular cam 74, each of which is fixed at an eccentric point to a shaft 76 extending transversely through the side walls 66 of the frame and journaled thereon. The shafts also extend through slots 78 formed in the aforementioned plates 70, said slots being indicated in FIG. 5.

The shaft 76 on at least one end is provided with a lever 80 so that the shaft can be rotated thereby to rotate the cams 74 carried thereby and thereby to cause plates 70 together with shaft 62 and roller 28 to move vertically in the frame of the machine.

In the lower position of the roller, it rests, as mentioned, on the flanges 22 at the upper edges of the food trays carried by the conveyor while in the upper position thereof the heat sealing roller 28 is spaced upwardly above the trays. The heat setting roller is shown in full lines in FIG. 2 in its lowered working position and in dot-dash lines in its upper idle position.

As to the rotary knife 36, this knife is mounted on a shaft 82 on which the aforementioned gear 38 is mounted. The ends of shaft 82 are journaled in respective arms 84 which, in turn, are mounted for rotation about the axis of shaft 86 on which gear 40 and sprocket 42 are mounted.

Figure 4:
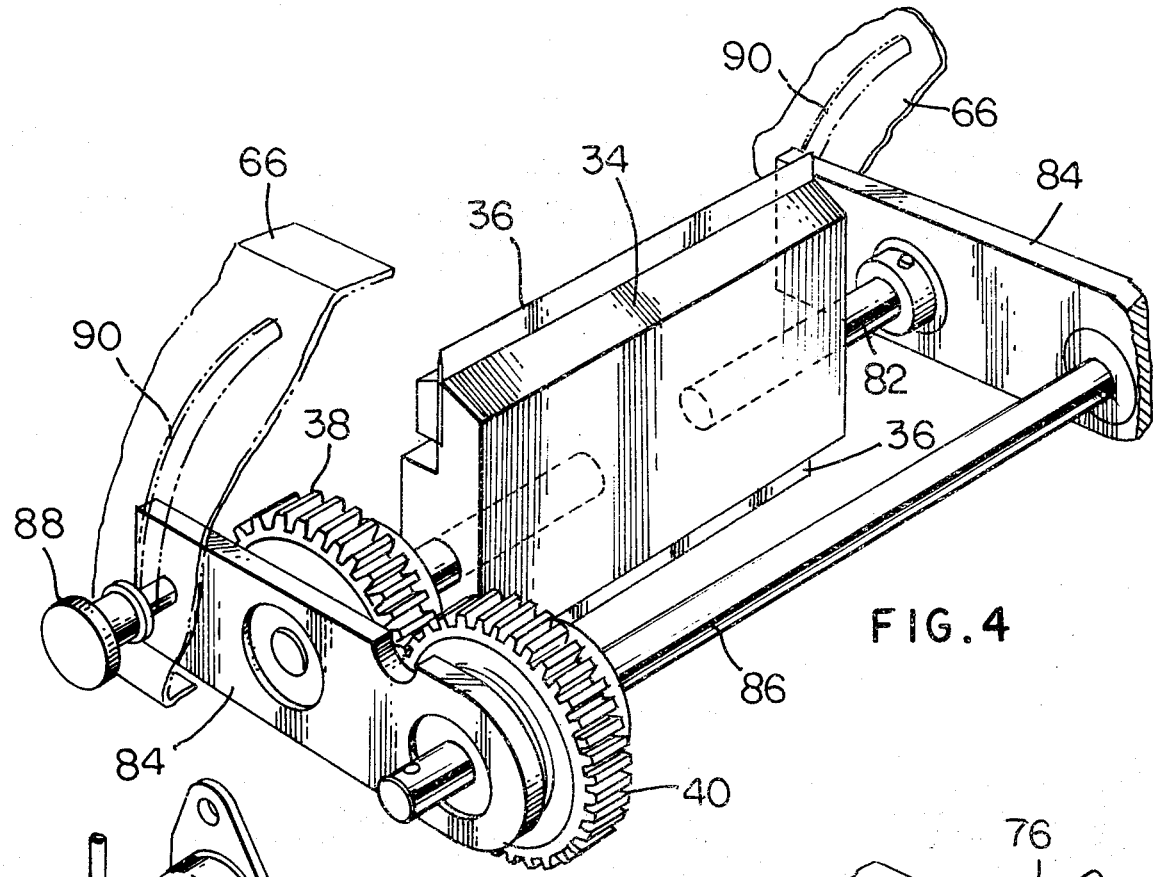
FIG. 4 is a perspective view showing the rotary cutter or severing blade and the moveable frame in which it is mounted.

At least one, or both, of the arms 84, as will be seen in FIG. 4, have clamp screws 88 associated therewith which are threaded into the arms and which extend through an arcuate slot 90 formed in the adjacent side wall 66 of the machine frame. It will be evident that the arms 84 are advantageously mounted inside the side walls of the frame and, thus, can be clamped thereto in angularly adjusted positions.

One or both of the arms 84 can be provided with adjustment members 92, if desired, which will insure that the cutting elements 36 on the cutter will have the proper depth for cutting the sealing material.

It is also possible to control a limit switch with one or the other of arms 84 so that the power supply to the heat sealing roller is interrupted when the cutter element and heat sealing roller are moved to retracted position.

Figure 2:
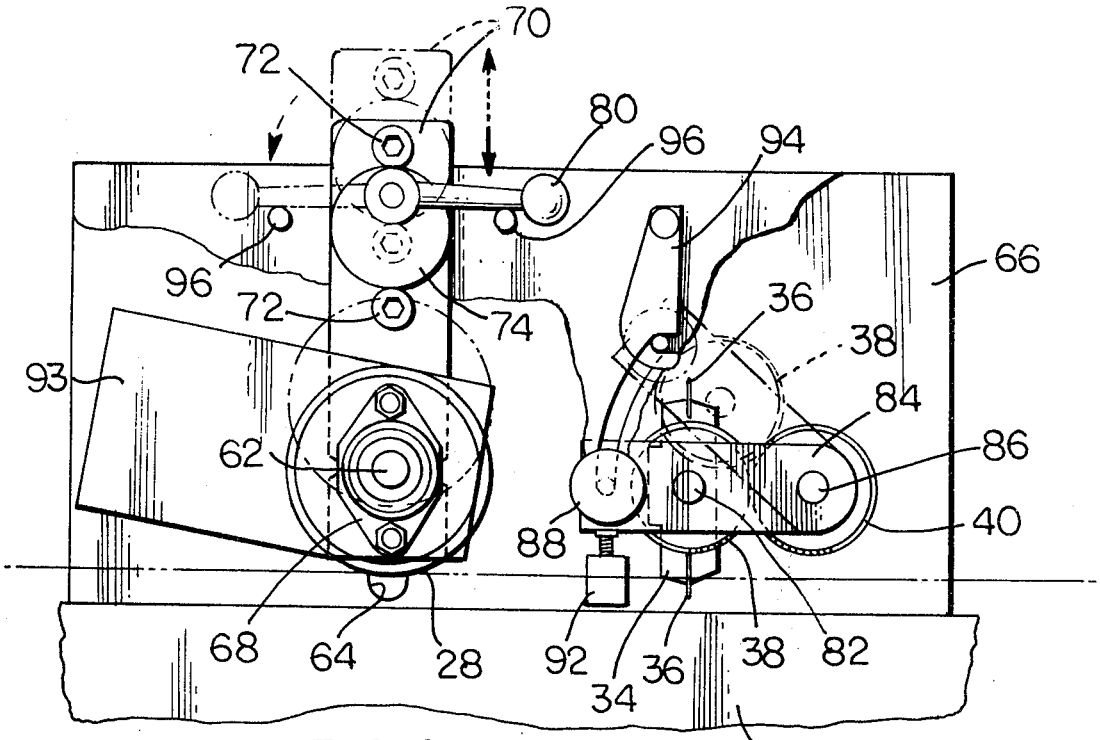
FIG. 2 is a side view of the machine looking in from the rearward side of FIG. 1 showing the adjustably mounted heat sealing roll and adjustably mounted cutter or severing blade.

FIG. 2 shows an arm 84 in lowered operative position and also in elevated inoperative position and also shows a swingable latch member 94 which can be mounted on the side wall of the housing and which is engageable with the adjacent clamp nut 88 when the cutter is moved to inoperative position. The latch 94 will insure that the cutter member will not accidentally become displaced from inoperative position.

FIG. 2 also discloses that the frame of the machine could carry stop pins 96 positioned for abutment by lever 80 on each of the two positions of the heat sealing roller. At least the lefthand one of pins 96 in FIG. 2 is advantageously positioned so that cams 74 are slightly beyond the center position, and this will insure that the heat sealing roller will remain in retracted position and will not become dislodged therefrom because of vibration of the machine.

The positioning of the righthand one of the pins 96 is not so critical because the heat sealing roller is adapted to bear on the flange portion 22 of the food trays passing therebeneath.

In respect of the heat sealing roller, the machine can include means for pushing the trays upwardly into firm pressure engagment with the roller during movement of the conveyor.

Modifications may be made within the scope of the appended claims.

What is claimed is:

1. In a packaging machine having a conveyor for conveying trays of foodstuff or the like in longitudinally adjacent relation along a generally horizontal path, first means including a sealing roller adjacent path and operable to apply a cover sheet to trays and to heat seal the cover sheet thereto during movement of the trays with the conveyor, second means in the form of a rotary cutter operable for severing the sheet sealed to the trays between adjacent ones of the trays, third means selectively operable for moving said first and second means away from the path of the trays into ineffective position, and drive means continuously driving said rotary cutter in timed relation to movement of the conveyor, in both the effective and ineffective positions of said rotary cutter, whereby trays of foodstuff may be selectively conveyed past the first and second means without being acted on thereby while still maintaining synchronization of the rotary cutter with the motion of the conveyor, and in which the conveyor comprises support members for supporting trays with the upper edges in alignment, chain means connected to said support members, a drive shaft, sprocket means on the drive shaft drivingly connected to the chain means, a first shaft supporting said rotary cutter and having a first gear thereon, a second shaft rotatable in the machine and having a second gear thereon meshing with said first gear, a sprocket on said second shaft drivingly connected to said drive shaft, said third means including arm means pivotal about the axis of said second shaft and rotatably supporting said first shaft.

2. A packaging machine according to claim 1 which includes means for holding said arm means in the position in the machine in which said rotary cutter is moved thereby into ineffective position.

3. A packaging machine according to claim 2 in which said arm means are weighted to apply a force on said rotary cutter when the rotary cutter is in effective position.

4. In a packaging machine having a conveyor for conveying trays of foodstuff or the like in longitudinally adjacent relation along a generally horizontal path, first means including a sealing roller adjacent said path and operable to apply a cover sheet to trays and to heat seal the cover sheet thereto during movement of the trays with the conveyor, second means in the form of a rotary cutter operable for severing the sheet sealed to the trays between adjacent ones of the trays, third means selectively operable for moving the first and second means away from the path of the trays into ineffective position, drive means continuously driving said rotary cutter in timed relation to movement of the conveyor in both the effective and ineffective positions of said rotary cutter, a support shaft for said sealing roller and bearings on said support shaft near the ends thereof, said third means including a member supporting each said bearing and reciprocable toward and away from the path of the trays, and cam means operatively engaging said members and movable in one direction to position said sealing roller adjacent the trays and in the other direction to position said sealing roller in spaced relation to the trays whereby trays of foodstuff may be selectively conveyed past the first and second means without being acted on thereby while still maintaining synchronization of the rotary cutter with the motion of the conveyor.

5. A packaging machine according to claim 4 in which said cam means includes a rotary cam adjacent each member, a cam support shaft rotatable in the machine and having said cams mounted thereon, and follower rollers on said members engaging the respective said cams.

6. A packaging machine according to claim 5 in which said members are slotted, said cam support shaft extending through the slots in said members, said cams being mounted on the ends of the cam support shaft which protrude through the slots in the members, said follower rollers being mounted on said members above and below said cams and in engagement therewith, and said machine being formed with vertical slots through which the support shaft for said sealing roller extend.

7. A packaging machine according to claim 6 in which said sealing roller is electrically heated.

8. A packaging machine according to claim 4 which includes means for supporting a roll of the film to be applied to trays, and means for guiding the film from the roll thereof to the top of the trays entering the region under the sealing roller.

9. A packaging machine according to claim 8 which includes means for biasing the trays upwardly into pressure engagement with the heat sealing roller.

10. In a packaging machine having a conveyor for conveying trays of foodstuff or the like in longitudinally adjacent relation along a generally horizontal path, first means including a sealing roller adjacent said path and operable to apply a cover sheet to trays and to heat seal the cover sheet thereto during movement of the trays with the conveyor, second means in the form of a rotary cutter operable for severing the sheet sealed to the trays between adjacent ones of the trays, third means selectively operable for moving said first and second means away from the path of the trays into ineffective position, drive means continuously driving said rotary cutter in timed relation to movement of the conveyor in both the effective and ineffective positions of said rotary cutter, a first shaft supporting said rotary cutter, a first gear on said first shaft, a second shaft rotatable in the machine and parallel to said first shaft, a second gear on said second shaft meshing with said first gear, said third means including said arm means rotatably supporting said first shaft and rotatable about the axis of said second shaft for movement of said rotary cutter between effective and ineffective positions without interrupting the meshing of said gears whereby trays of foodstuff may be selectively conveyed past the first and second means without being acted on thereby while still maintaining synchronization of the rotary cutter with the motion of the conveyor.

11. In a packaging machine having a conveyor for conveying trays of foodstuff or the like in longitudinally adjacent relation along a generally horizontal path, first means including a sealing roller adjacent said path and operable to apply a cover sheet to trays and to heat seal the cover sheet thereto during movement of the trays with the conveyor, second means in the form of a rotary cutter operable for severing the sheet sealed to the trays between adjacent ones of the trays, third means selectively operable for moving said first and said second means away from the path of the trays into ineffective position, drive means continuously driving said rotary cutter in timed relation to movement of the conveyor in both the effective and ineffective positions of said rotary cutter, wherein the conveyor includes chain means, a drive shaft, sprocket means on said drive shaft connected to said chain means, said drive means for said rotary cutter being drivingly connected to said drive shaft and wherein the sealing roller is driven solely by frictional engagement by the moving conveyor and only when in the effective position, whereby trays of foodstuff may be selectively conveyed past the first and second means without being acted on thereby while still maintaining synchronization of the rotary cutter with the motion of the conveyor.

* * * * *